US007131816B2

(12) United States Patent
Synnott et al.

(10) Patent No.: US 7,131,816 B2
(45) Date of Patent: Nov. 7, 2006

(54) AIRFOIL LOCATOR RIB AND METHOD OF POSITIONING AN INSERT IN AN AIRFOIL

(75) Inventors: Remy Synnott, St-Jean-sur-Richelieu (CA); Eric Durocher, Vercheres (CA)

(73) Assignee: Pratt & Whitney Canada Corp., Québec (CA)

( * ) Notice: Subject to any disclaimer, the term of this patent is extended or adjusted under 35 U.S.C. 154(b) by 115 days.

(21) Appl. No.: 11/049,977

(22) Filed: Feb. 4, 2005

(65) Prior Publication Data

US 2006/0177309 A1 Aug. 10, 2006

(51) Int. Cl.
*F01D 5/18* (2006.01)

(52) U.S. Cl. ..... 416/96 A; 416/224

(58) Field of Classification Search ..... 416/96 R, 416/96 A, 232, 233, 224
See application file for complete search history.

(56) References Cited

U.S. PATENT DOCUMENTS 3,636,587 A 1/1972 Giesman et al.
4,183,716 A 1/1980 Takahara et al.
5,259,730 A 11/1993 Damlis et al.
6,120,244 A 9/2000 Fukura
6,193,465 B1 2/2001 Liotta et al.
6,318,960 B1 11/2001 Kuwabara et al.
6,428,273 B1 8/2002 Keith et al.
6,450,759 B1 9/2002 Miller et al.
6,453,557 B1 9/2002 Burdgick
6,742,984 B1 6/2004 Itzel et al.
6,874,988 B1 * 4/2005 Tiemann ..... 415/115

* cited by examiner

*Primary Examiner*—Edward K. Look
*Assistant Examiner*—Dwayne J White
(74) *Attorney, Agent, or Firm*—Ogilvy Renault LLP

(57) ABSTRACT

An airfoil for a gas turbine engine, the airfoil comprising a locator rib provided at a bottom of a cavity in the airfoil core, the locator rib having an inclined surface to be engaged by a leading end of the insert during installation thereof in the cavity.

6 Claims, 3 Drawing Sheets

AIRFOIL LOCATOR RIB AND METHOD OF POSITIONING AN INSERT IN AN AIRFOIL

TECHNICAL FIELD

The invention relates generally to the positioning of insert in an airfoil and, more particularly, to an improved way of positioning an insert in an airfoil during manufacturing.

BACKGROUND OF THE ART

Some of the cooled airfoils used in several gas turbine engines are provided with inserts. These airfoils may have one or several inserts, each positioned in a corresponding cavity provided in the airfoil core. The cavity is generally defined in a cooling passage of the airfoil and inserts are generally held by individual standoffs which keep them away from the internal walls of the airfoil.

Each insert is brought into the cavity through an opened end and is pushed therein until its leading end abuts the bottom of the cavity. It is thereafter welded or otherwise rigidly secured to the airfoil core. The conventional positioning feature is a continuous chamber or a continuous shoulder around the airfoil, which needs more space underneath the insert platform of the vane to correctly position the insert. This adds weight to the vane.

The positioning of the insert relative to the airfoil core must usually be very accurate. Any misalignment of the insert relative to the airfoil core once it is rigidly secured may result in that the whole airfoil be considered defective and will not go into service.

Accordingly, there is a need to provide an airfoil which allows a more accurate positioning an insert therein.

SUMMARY OF THE INVENTION

In one aspect, the present invention provides an airfoil for a gas turbine engine, the airfoil having at least one internal cooling passage generally defining at least one cavity in which is located an insert, the airfoil comprising a locator rib provided at a bottom of the cavity, the locator rib having an inclined surface to be engaged by a leading end of the insert during positioning thereof in the cavity.

In a second aspect, the present invention provides an airfoil core for use in a gas turbine engine, the airfoil core including internal walls defining a cavity for receiving an insert, the cavity having opposite opened and bottom ends, the airfoil core including a locator rib provided at a junction between two walls at the bottom end of the cavity.

In a third aspect, the present invention provides a method of positioning an insert in an internally-cooled airfoil, the method comprising: moving the insert into a cavity provided in the airfoil; bringing a leading side of the insert into engagement with a located rib inside the cavity; and offsetting the insert in a substantially chordwise direction as the leading end slides over an inclined surface of the locator rib.

Further details of these and other aspects of the present invention will be apparent from the detailed description and the appended figures.

DETAILED DESCRIPTION

Figure 1:
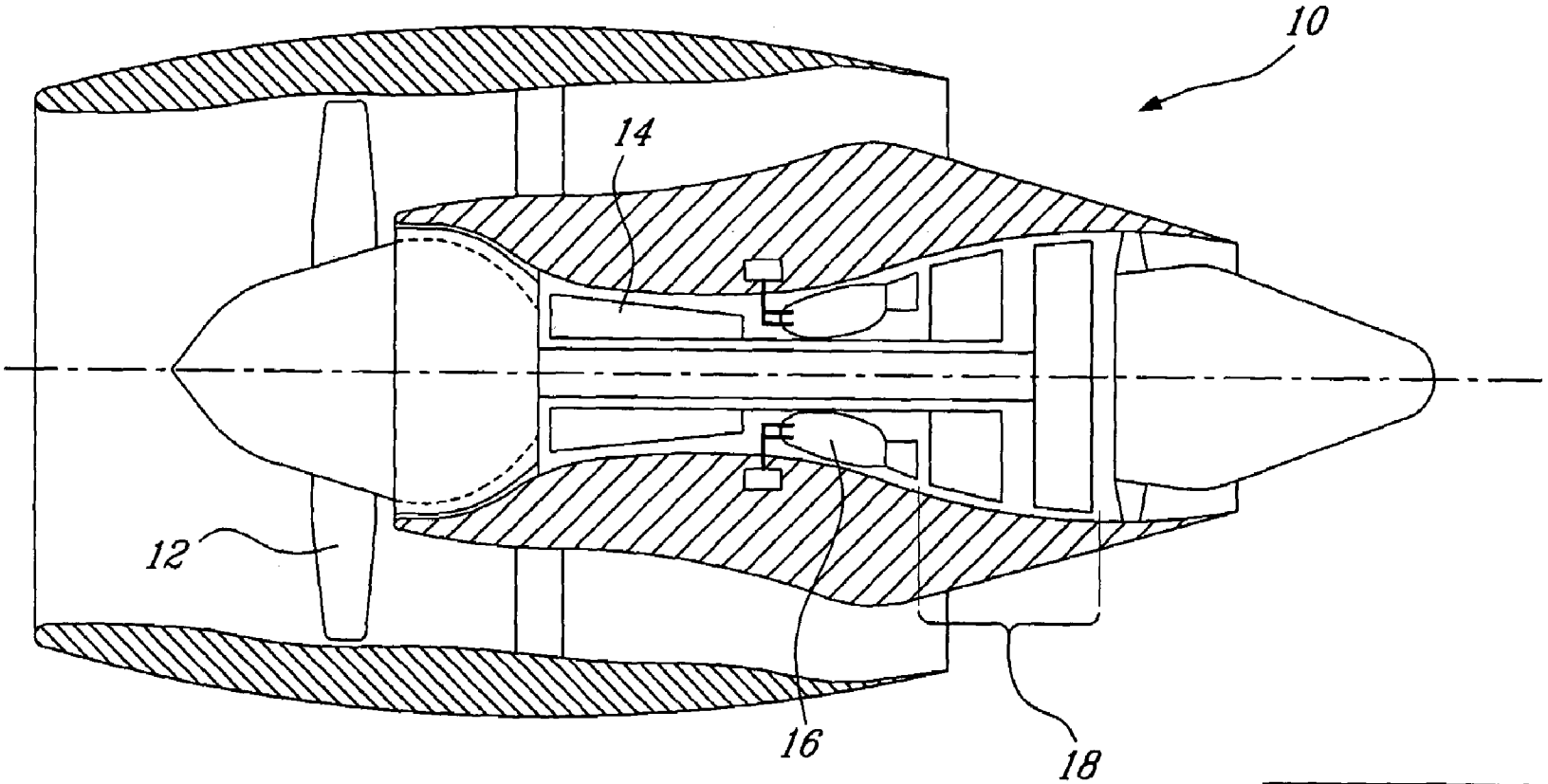
FIG. 1 schematically shows a generic gas turbine engine to illustrate an example of a general environment in which the invention can be used.

FIG. 1 schematically illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. This figure illustrates an example of the environment in which the present invention can be used.

Figure 2:
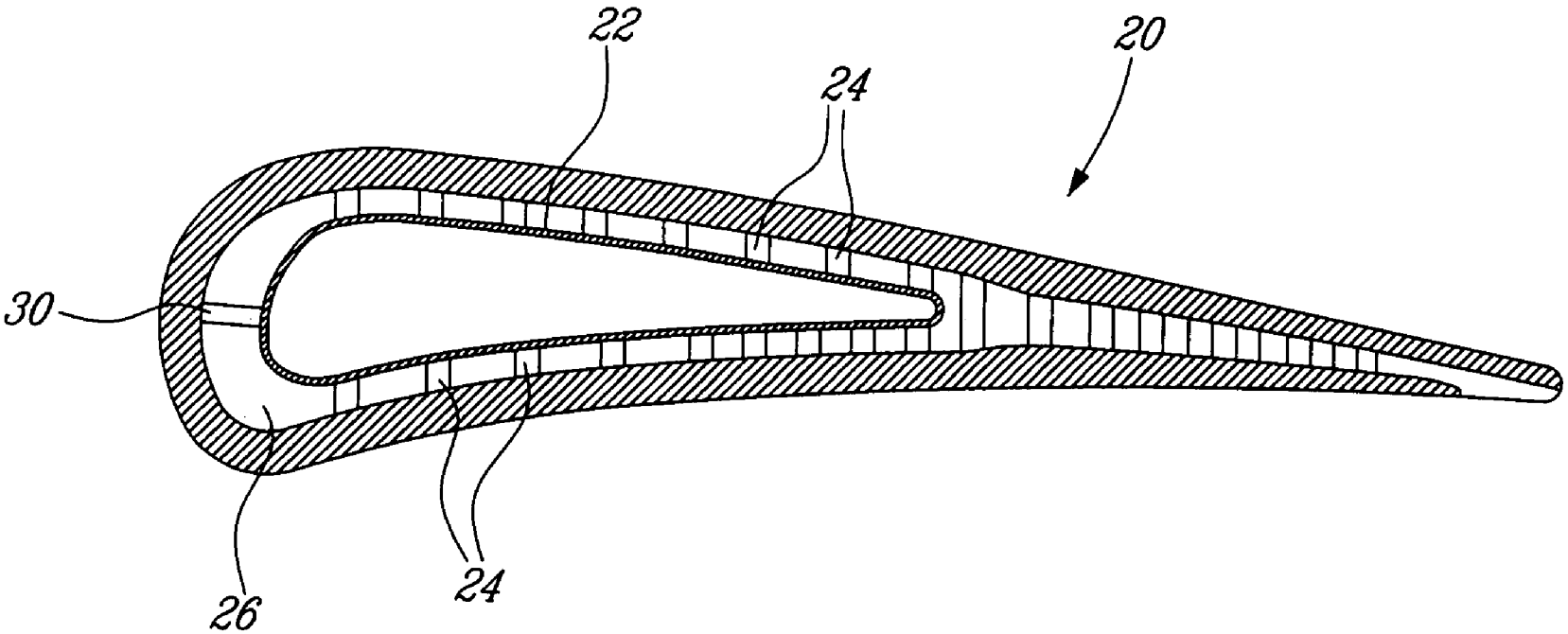
FIG. 2 is a semi-schematic cross-sectional view of an airfoil provided with an insert and a locator rib in accordance with a preferred embodiment of the present invention.

FIG. 2 is a semi-schematic representation of a cross section of an airfoil (20) in which is positioned one insert (22). The insert (22) is maintained in place on the sides by standoffs (24) projecting from the internal walls of the airfoil (20). These walls generally define a cavity (26) which is also a portion of the internal passage of the airfoil (20) in which cooling air flows when the gas turbine engine (10) is in operation. FIG. 2 shows that the core of the airfoil (20) comprises a locator rib (30) located at the bottom of the cavity (26). This bottom location is also referred to as the closed end, which end is opposite to an opened end through which the insert (22) is inserted during manufacturing. The locator rib (30) includes an inclined surface (30A) which can be engaged by the leading end (22A) of the insert (22) in the final stages of the positioning of the insert (22). This locator rib (30) is generally oriented parallel to the chordwise direction of the airfoil (20). It should be noted at this point that the opened end is not necessarily located at the tip of the airfoil (20) and it may be located closer to the root. In that case, the closed (or bottom) end would be adjacent to the tip of the airfoil (20).

Figure 3:
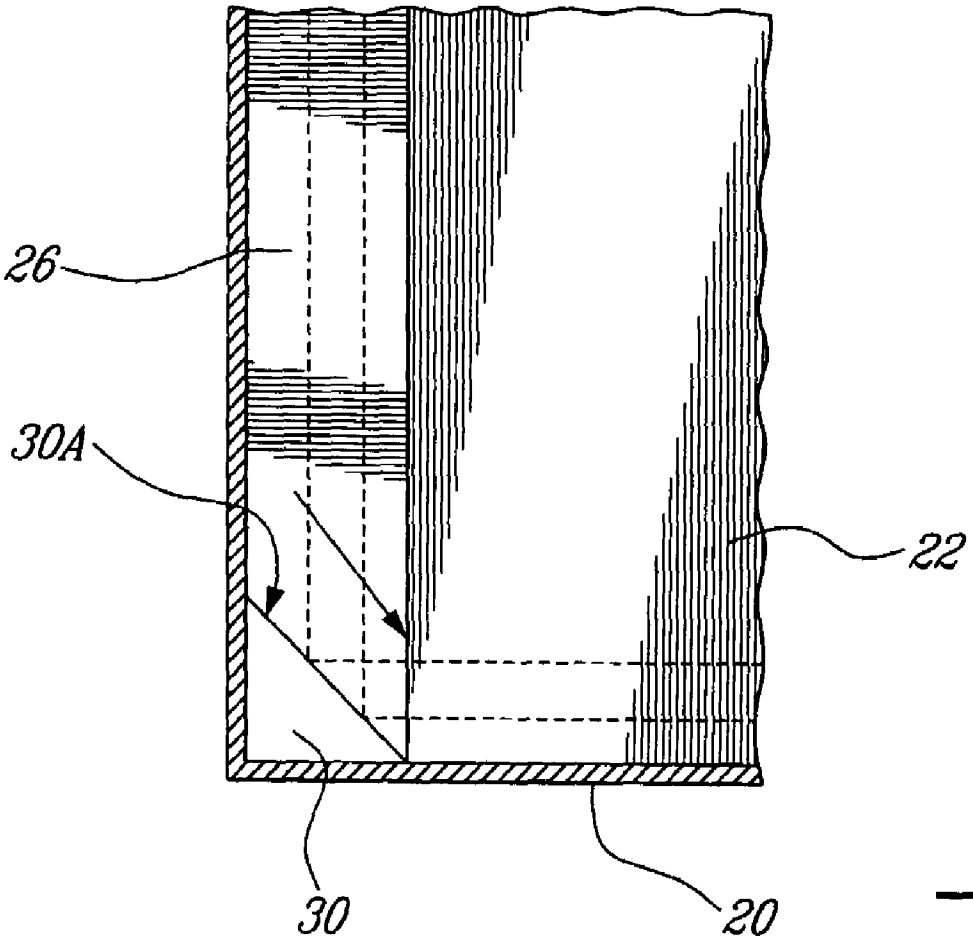
FIG. 3 is a schematic side view showing a locator rib and a portion of the leading end of the insert shown in FIG. 2.

FIG. 3 is an enlarged schematic view of an airfoil core with an example of a locator rib (30). The dotted lines represent the position of the insert (22) during its positioning in the cavity (26) of the airfoil (20).

When pushing the insert (22) into the cavity (26), and if the insert (22) is forwardly offset with reference to its ideal position into the cavity (26), it will contact the inclined surface (30A) of the locator rib (30). Pushing the insert (22) further will cause the insert (22) to slide along the inclined surface (30A) until it reaches the bottom. This way, the insert (22) would not be positioned too close to the leading edge of the airfoil (20).

The present invention provides a significant weight reducing. Instead of having a continuous shoulder or chamber, only a small thin local rid is required to locate the insert.

The above description is meant to be exemplary only, and one skilled in the art will recognize that changes may be made to the embodiment described without department from the scope of the invention disclosed; For example, the locator rib (30) can have a shape different than what is shown. More than one locator rib (30) can be used to position a same insert (22). Locator ribs (30) can be used on the lateral sides or at the rear. The inclined surface (30A) may have another shape than a straight surface. For instance, it may be curved or have two or more subsections with different angles. Still other modifications which fall within the scope of the present invention will be apparent to those skilled in the art, in light of a review of this disclosure, and such modifications are intended to fall within the appended claims.

What is claimed is:

1. An airfoil for a gas turbine engine, the airfoil having at least one internal cooling passage generally defining at least one cavity in which is located an insert, the airfoil comprising a locator rib provided at a bottom of the cavity, the locator rib having an inclined surface to be engaged by a leading end of the insert during positioning thereof in the cavity.

2. The airfoil as defined in claim 1, wherein the locator ribs extend in a substantially chordwise direction.

3. An airfoil core for use in a gas turbine engine, the airfoil core including internal walls defining a cavity for receiving an insert, the cavity having opposite opened and bottom ends, the airfoil core including a locator rib provided at a junction between two walls at the bottom end of the cavity.

4. The airfoil core as defined in claim 3, wherein the locator ribs extend in a substantially chordwise direction.

5. A method of positioning an insert in an internally-cooled airfoil, the method comprising:

moving the insert into a cavity provided in the airfoil;

bringing a leading side of the insert into engagement with a located rib inside the cavity; and offsetting the insert in a substantially chordwise direction as the leading end slides over an inclined surface of the locator rib.

6. The method as defined in claim 5, wherein after the step of offsetting the insert, the insert is rigidly attached to the airfoil.

* * * * *